United States Patent [19]

Pace

[11] Patent Number: 4,845,485

[45] Date of Patent: Jul. 4, 1989

[54] COMBINED RADIO PAGER/TIMEPIECE APPARATUS WITH RECEIVER DESENSITIZATION PROTECTION

[75] Inventor: Gary L. Pace, Boca Raton, Fla.

[73] Assignee: Motorola, Inc., Schaumburg, Ill.

[21] Appl. No.: 139,239

[22] Filed: Dec. 29, 1987

[51] Int. Cl.[4] ..... G08B 5/22

[52] U.S. Cl. ..... 340/825.440; 368/10; 455/344

[58] Field of Search ..... 340/825.44; 368/80, 368/327, 47, 82, 10, 113, 118, 120; 455/344

[56] References Cited

U.S. PATENT DOCUMENTS

| | | | |
|---|---|---|---|
| 3,540,207 | 11/1970 | Keeler | 368/82 |
| 3,937,004 | 2/1976 | Natori et al. | 340/825.44 |
| 4,181,893 | 1/1980 | Ehmke . | |
| 4,518,961 | 5/1985 | Davis et al. | 340/825.44 |
| 4,650,344 | 3/1987 | Allgaier et al. | 368/47 |
| 4,663,624 | 5/1987 | Bui et al. | 340/825.44 |
| 4,713,808 | 12/1987 | Gaskill et al. | 370/93 |
| 4,755,816 | 7/1988 | DeLuca | 340/825.44 |

*Primary Examiner*—Donald J. Yusko
*Assistant Examiner*—Eric Oliver Pudpud, Sr.
*Attorney, Agent, or Firm*—Michael J. DeLuca; Vincent B. Ingrassia

[57] ABSTRACT

A combined radio pager/analog timepiece that may be worn on the wrist of the user is described. The device includes a stepping motor to periodically advance the second hand of the watch portion. The voltage pulse device signals to the timepiece are effectively inhibited during those intervals when the paging receiver is activated. Receiver activation occurs so as to monitor its communication channel or actually process an intended message if its unique address has been received and detected. These inhibited, i.e. delayed, voltage device pulses are later applied to the stepping motor on an accelerated basis to bring the timepiece to current time status.

12 Claims, 2 Drawing Sheets

COMBINED RADIO PAGER/TIMEPIECE APPARATUS WITH RECEIVER DESENSITIZATION PROTECTION

BACKGROUND OF THE INVENTION

The present invention relates generally to radio pagers and, more particularly, to a combined pager/ timepiece applicance that may be worn on the wrist of the user wherein the pager portion thereof is protected from desensitization that may otherwise occur when the associated stepping motor controlling the timepiece is in operation.

In the evolution of radio pagers, miniaturization has become the watchword. The state of the art is now at the point where the pager device may be worn on the wrist of the user. this in turn affords the opportunity to combine such paging device with a timepiece to provide a very useful and highly desirable personalized appliance.

One potential, and perhaps, obvious arrangement of the foregoing type is a pager combined with an analog watch with hour, minute and second hands suitably controlled by a pulsed stepping motor. The stepping motor is conventionally controlled by voltage pulses at regular intervals to increment the second and in turn the minute and hour hands and thereby causing the correct time to be displayed. The voltage pulses may be generated from an internal reference oscillator that also serves a function in the data processing operation of the pager portion of the device or, alternatively, separate oscillators may be provided. It will be appreciated that these reference voltage pulses applied to the associated stepping motor may well result in a degradation in performance regarding the radio pager operation under certain operating conditions. These deleterious effects are usually in the form of RF radiation generated by the stepping motor which results in a desensitization of the paging receiver itself. How severe is dependent upon many factors, but it is fair to note that any desensitization necessarily says that the paging receiver is simply not performing to its designed capability, and therefore undesirable.

Additionally, the varying current drain of the battery may well cause still additional degradation in the paging receiver performance. That is, the variable increase in battery current during stepping motor operation may well reduce the voltage level at the battery terminals which in turn results in less than optimum operating levels for the paging receiver circuitry again, adding to receiver sensitivity degradation.

SUMMARY OF THE INVENTION

Accordingly, it is an object of the present invention to provide a combined radio pager/timepiece personalized device in which the foregoing deficiencies have been overcome.

A more particular object of the present invention is to provide a combined pager/timepiece device of the foregoing type wherein the stepping motor operation is effectively inhibited during select times when the paging receiver is operative and is caused to catch up at subsequent time intervals.

In practicing the invention, a combined radio paging receiver/analog timepiece device is provided which includes hour, minute, and second hands controlled by a stepping motor. Normally the stepping motor is activated by a voltage pulse applied at regular intervals, such as every one second. However, when the data processor of the pager/watch device is sampling the air waves for its address and/or associated paging message, means are provided to inhibit any applied voltage pulses to the stepping motor during those times. At the same time, a seconds register is incremented and later utilized to cause the data processor to generate and apply the appropriate delayed voltage pulses to the stepping motor in a sequential but accelerated fashion so as to bring the timepiece to current time status.

BRIEF DESCRIPTION OF THE DRAWINGS

The features of the present invention which are believed to be novel are set forth with particularity in the appended claims. The invention itself, however, together with further objects and advantages thereof, may be best understood by reference to the accompanying drawings, in which:

DESCRIPTION OF THE PREFERRED EMBODIMENT

Figure 1:
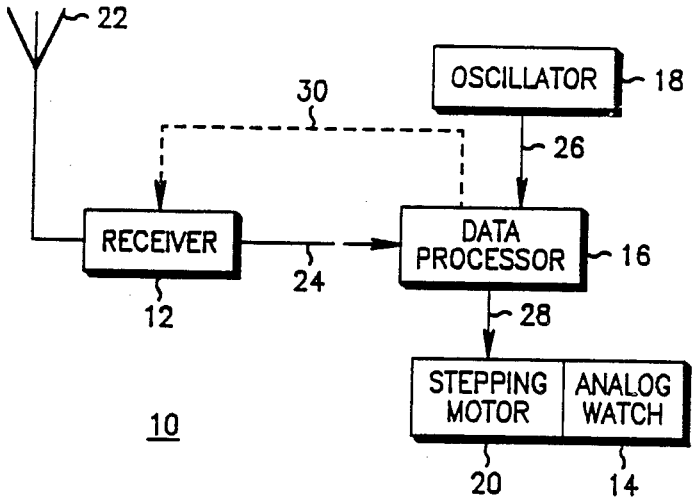
FIG. 1 is a block diagram of a combined radio paper-/analog watch timepiece in which the present invention may be advantageously utilized.

Referring now to the drawings a block diagram of the combined radio pager/analog timepiece device 10 is shown which has been constructed in accordance with the present invention. The device 10 itself includes a separate paging receiver section, indicated at 12, as well as an analog watch portion 14. A common oscillator 18 is provided in combination with a data processor 16. The analog watch portion also includes an associated stepping motor 20. An external antenna 22 is further included to respond to communication signals which may include the pagers' unique address as well as any associated messages intended therefor which may be transmitted from time to time. Communication signals may be in the form of binary digits (bits) modulated on a carrier frequency of a given value.

As well understood by those skilled in the art, the receiver 12 of the combined pager/watch device 10 responds to the signals transmitted and received by antenna 22. Receiver 12 detects, removes and passes the binary information (digits) to the data processor 16 on line 24, as illustrated. Data processor 16, again in the well known manner, processes the detected binary information to determine if the pagers address is present, and, if so, to further process any associated message intended therefor. The timing (clock) signals to permit such data processing is provided by oscillator 18.

This oscillator 18 also serves to provide the timing signals for the data processor 16 in generating and applying the necessary periodic voltage pulses to the steppng motor 20 so as to intermittently move the watch second hand at regular (i.e., one second) intervals. In this manner, the analog watch section accurately and continuously displays current time.

As indicated, data processor 16 may also provide a "battery saver" strobe signal to the receiver on a periodic basis whereby the receiver, normally powered-down, comes up to full operating level and monitors the airwaves and determine if there is a signal being transmitted which is of interest to the pager portion of the device 10. At all other times, the receiver is in a deactivation state. This battery saver function is, of course, entirely optional and may be omitted without material affect on the invention here disclosed. For purposes of completeness, however, it will be assumed that such feature is incorporated in the disclosed pager 10.

Typically, a paging channel is "sampled" by the paging portion of the device 10 at about 0.5 seconds or longer interval, with the sampling duration typically being about 15 percent of the sampling interval. The sampling time and intervals are entirely arbitrary and may be varied as desired. The maximum sampling time required to receive the pager address and associated message in a transmitted page is typically less than one second. The operation of the battery saver strobe or sampling signal in monitoring the channel is well understood in the art and a detailed description is deemed unnecessary in the present disclosure. A complete operational description of a pager with battery saver operation of a type which may be advantageously utilized in the present invention is included in U.S. Pat. No. 4,181,893, issued to Edward L. Ehmke, and assigned to the same assignee as the present invention.

In addition, in the analog watch portion 14 of the device 10, the stepping motor 20 normally receives an applied voltage pulse from the data processor 16 at regular occurring intervals. Typically this would be one second if the watch has a second hand, or perhaps some different value, if no second hand is utilized. The applied voltage pulse causes the stepping motor 20 to increment one time unit whatever that unit is chosen to be, in this case, however, one second. In this manner, time keeping is kept current and the correct time displayed.

As previously mentioned, this applied voltage pulse to the stepping motor 20 may result in degradation in the paging receiver performance if so applied during those instances where the receiver 12 is active in receiving and detecting transmitted information. This reduction in performance can be the result of RF radiation generated by the stepping motor, which degrades receiver sensitivity. In addition, depending on the type of battery utilized, varying battery current drain may further result in lower operating voltage levels which may also contribute to a further reduction in receiver sensitivity.

This undesirable paging receiver desensitization is effectively avoided in the present invention by a programmed interrupt in the applied stepping motor pulse drive signals during active receiver operation. These inhibited pulses are later recovered and applied at a subsequent time during paging receiver deactivation. The subsequent applied voltage pulses are on a speeded up or accelerated basis until the associated timepiece is brought to current time status. For most watch users, it is completely unnoticeable that the operation of the stepping motor is occasionally increased or decreased, or that the timepiece itself is temporarily in error regarding time display in terms of one or more seconds.

Figure 2:
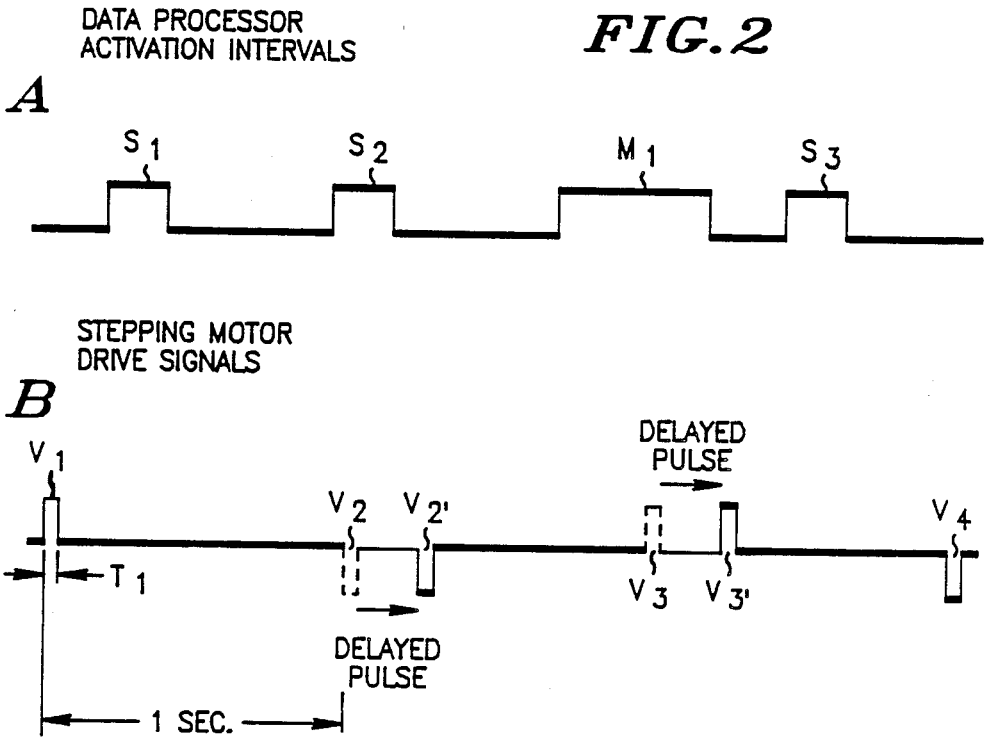
FIG. 2 is a graphical representation of the timing diagram for signals generated by the data processor of the pager/watch device.

The present invention takes advantage of this characteristic and inhibits the occurrence of an applied stepping motor voltage pulse during the times a paging receiver is sampling transmitted information on a paging channel or during which the receiver is processing an intended message. This is effectively illustrated in graphic form in FIG. 2. Line A depicts various of the battery strobe sampling signals $S_1$, $S_2$ and $S_3$ as well as an interval during which an associated pager message is being processed, such as that shown at $M_1$. Line B depicts the voltage pulse $V_1$, $V_2$, $V_3$ and $v_4$ for stepping motor 20 generated by the data processor 16 at regular intervals. These voltage pulses are of a time duration $T_1$ which conventionally are shorter than that of sampling pulses $S_1$–$S_3$. As is customary in the watch art, pulses of alternating polarities are utilized. That is, pulses $V_1$ and $V_3$ are shown as positive going while $V_2$ and $V_4$ are shown as negative going.

Normally, the sampling signals or battery strobes $S_1$–$V_4$. These voltage pulses are shown as occurring at a one second rate. Whenever a voltage pulse V is to occur during a time when the paging receiver 12 is sampling during an S interval, or additionally during an interval M in which an actual paging message is being processed, that voltage pulse is inhibited, or more correctly, delayed for application at a later time. This is depicted in regard to voltage pulses $V_2$ and $V_3$. The former would otherwise occur during the $S_2$ sample interval and the latter during the $M_1$ message processing interval. In each case, the voltage pulse is dealyed to a time in which the paging receiver 12 is in a deactivated mode. Pulse $V_2$ is delayed to $V_2'$ and pulse $V_3$ is delayed to $V_3'$. Accordingly, it is to be noted that the interval between pulses $V_1$ and $V_2'$ is greater than one second and that between $V_3'$ and $V_4$ is less than one second.

The inhibition, delay and subsequent application of certain of the stepping motor voltage pulse drive signals is effected by the data processor 16 includes a microprocessor which has been programmed to effect various routines regarding both paging operation and time keeping functions. Two of such routines, or more correctly, subroutines, are set forth in FIGS. 3*a* and 3*b*.

Figure 3B:
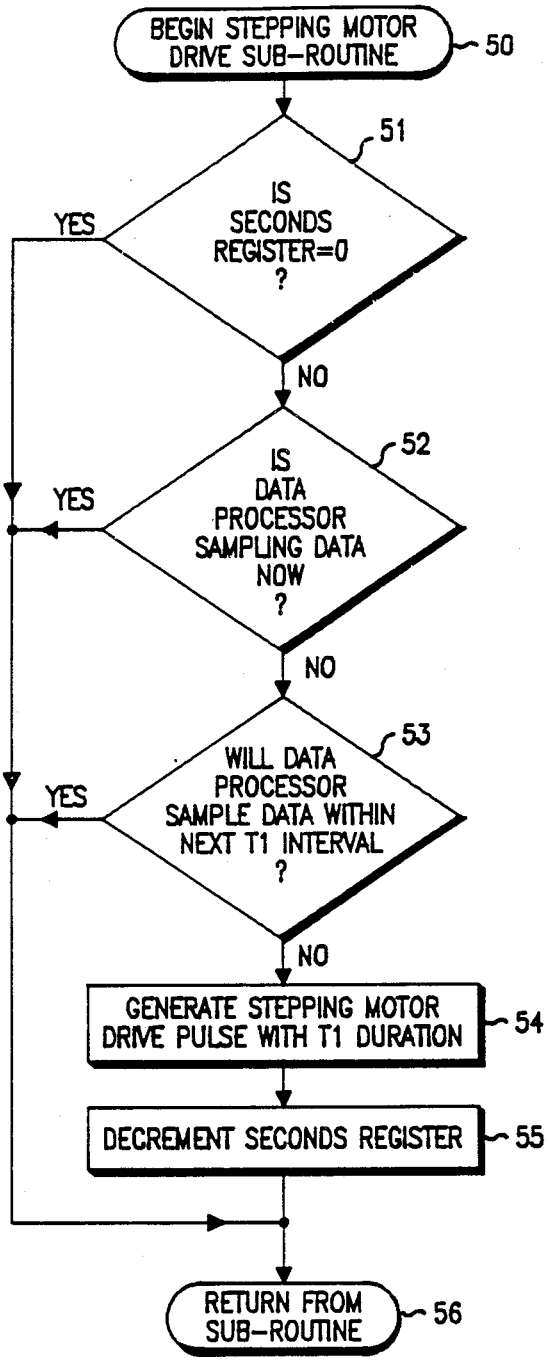
FIGS. 3*a* and 3*b* are flowcharts which describe the operation of the referenced data processor.
Figure 3A:
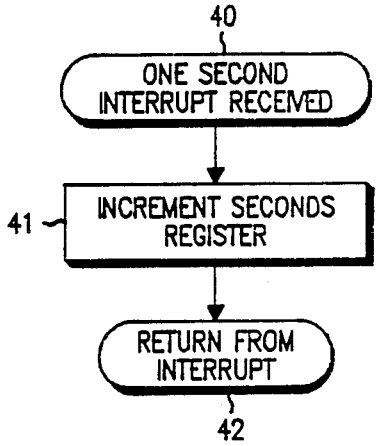

FIG. 3*a* represents the normal interrupt subroutine for time keeping purposes. The seconds register as therein shown is initialized to zero following initial power-up of the data processor 16. The data processor contains a timer which generates an interrupt to the main control program once every second. The interrupt service routine is used to increment the seconds register 41 once each second. As indicated, a one second interrupt is received at step 40, which in turn causes the seconds register (not shown) in the data processor 16 to increment one time unit, after which a return from interrupt is effect at step 42. This routine occurs on a regular basis, i.e., every one second without interruption.

The subroutine for generating and applying the stepping motor drive signal is set forth with particularity in FIG. 3*b*. This subroutine of necessity occurs at a higher rate than the one second interrupt routine shown in FIG. 3*a* . This is because the delayed voltage drive signals must be subsequently applied on an accelerated basis to bring the timepiece up to current time status. This subroutine may be programmed to run several times, perhaps as high as ten times, a second.

In each instance of running the stepping motor drive subroutine 50, the seconds register is first checked at step 51 to see if the register has been incremented (see step 41 in FIG. 3*a*) or whether it contains a zero value. If the latter, the return from subroutine at step 56 is immediately initiated. This means that the timepiece is at current time. However, if the register contains a nonzero value, the data processor 16 is checked at step 52 to determine if it is in the data sampling mode. If yes, the return from subroutine is again initiated at step 56. If no, it is to be determined whether the data processor 16 will in fact sample data within the next time interval $T_1$, the duration of an applied stepping motor voltage pulse V. If so determined in step 53, the return from subroutine is again initiated. If not so, the generation of a stepping motor voltage pulse occurs and is duly applied at step 54. If that occurs, the seconds register is decremented one time unit at step 55 before the return from subroutine is initiated at step 56. Since stepping motor drive subroutine 50 occurs at at sub-second or multiple times per second rate, the generation of additional voltage pulses will occur on an accelerated basis until the referenced seconds register is fully decremented to a zero value and the timepiece is at current time status.

Accordingly, what is claimed is:

1. In a combination radio pager/time piece device with moving hour, minute and second hands controlled by a stepping motor, an arrangement for preventing pager receiver desensitization during stepping motor operation, comprising in combination:

first means for momentarily activating the paging receiver at substantially regular intervals to determine if its address has been transmitted and for processing paging messages when its address has been received and detected;

second means for supplying voltage pulses to the time piece stepping motor at regular intervals to advance the second hand; and third means coupled to said second means and responsive to said first means for inhibiting said voltage pulses to the stepping motor during those intervals when the paging receiver has been activated, said last named means further including fourth means for subsequently applying said inhibited voltage pulses on a sequential but accelerated basis upon deactivation of the paging receiver so as to bring the time piece up to current time status.

2. An arrangement for preventing receiver desensitization in accordance with calim 1 wherein said first means said second means for periodically activating the paging receiver and for supplying voltage pulse drive signal to the stepping motor comprises a data processor controlled by a reference oscillator.

3. An arrangement for preventing receiver desensitization in accordance with claim 2 wherein the data processor includes a microprocessor for inhibiting and later applying said delayed voltage pulse drive signals to the stepping motor.

4. An arrangement for preventing receiver desensitization in accordance with claim 1 wherein the voltage pulses initially applied to the stepping motor are on a one second basis and said delayed pulses are applied on an accelerated basis of less than one second.

5. An arrangement for preventing receiver desensitization in accordance with claim 1 wherein said third means for inhibiting said voltage pulses includes means for inhibiting such pulses during those intervals when the paging receiver is activated as well as an additional interval T1 during which the receiver may become activated.

6. An arrangement for preventing receiver desensitization in accordance with claim 5 wherein the additional interval T1 corresponds substantially to the time period of a stepping motor voltage pulse drive signal.

7. A method of preventing receiver desensitization in a combination radio pager-analog time piece device when operating the associated stepping motor during intervals when the paging receiver is also activated, comprising the steps of:

momentarily activating the paging receiver at substantially regular intervals to determine if its address has been transmitted and for processing paging messages when its address has been received and detected;

supplying voltage pulses to the time piece stepping motor at regular intervals to advance its second hand;

inhibiting said voltage pulses to the stepping motor during those intervals when the paging receiver has been activated; and subsequently applying said inhibited voltage pulses on a sequential but accelerated basis upon deactivation of the paging receiver so as to bring the time piece up to current time status.

8. A method of preventing receiver desensitization in accordance with claim 7 wherein said steps of periodically activating the paging receiver and for supplying voltage pulse drive signal to the stepping motor are effected by an included data processor controlled by a reference oscillator.

9. A method of preventing receiver desensitization in accordance with claim 8 wherein the data processor includes a microprocessor for inhibiting and later applying said delayed voltage pulse drive signals to the stepping motor.

10. A method of preventing receiver desensitization in accordance with claim 7 wherein the voltage pulses initially applied to the stepping motor are on a one second basis and said delayed pulses are applied on an accelerated basis of less than one second.

11. A method of preventing receiver desensitization in accordance with claim 7 wherein the inhibiting of said voltage pulses includes inhibiting such pulses during those intervals when the paging receiver is activated as well as an additional interval T1 during which the receiver may become activated.

12. A method of preventing receiver desensitization in accordance with claim 11 wherein the additional interval T1 corresponds substantially to the time period of a stepping motor voltage pulse drive signal.

* * * * *